US007793437B2

(12) United States Patent
Chapman et al.

(10) Patent No.: US 7,793,437 B2
(45) Date of Patent: Sep. 14, 2010

(54) SHOE SOLE

(75) Inventors: Steven Chapman, 658 N. Dexter Rd., Dexter, ME (US) 04930; Roger C. Dutilly, Radioville, PR (US); Pavan Singh, Leon (MX)

(73) Assignee: Steven Chapman, Dexter, ME (US)

( * ) Notice: Subject to any disclaimer, the term of this patent is extended or adjusted under 35 U.S.C. 154(b) by 687 days.

(21) Appl. No.: 11/649,418

(22) Filed: Jan. 4, 2007

(65) Prior Publication Data

US 2008/0163513 A1 Jul. 10, 2008

(51) Int. Cl.
*A43B 13/14* (2006.01)
*A43B 3/12* (2006.01)

(52) U.S. Cl. ..... 36/88; 36/25 R; 36/142

(58) Field of Classification Search ..... 36/88, 36/102, 25 R, 31, 142–144
See application file for complete search history.

(56) References Cited

U.S. PATENT DOCUMENTS 4,041,619 A * 8/1977 Sapper ..... 36/25 R
4,155,180 A 5/1979 Phillips
4,262,433 A * 4/1981 Hagg et al. ..... 36/25 R
4,309,832 A * 1/1982 Hunt ..... 36/32 R
4,348,821 A * 9/1982 Daswick ..... 36/103
4,425,721 A * 1/1984 Spronken ..... 36/11.5
4,535,554 A 8/1985 De Obaldia
4,756,096 A 7/1988 Meyer
5,088,481 A * 2/1992 Darby ..... 602/23
5,483,757 A 1/1996 Frykberg
5,572,805 A * 11/1996 Giese et al. ..... 36/30 R
5,592,757 A * 1/1997 Jackinsky ..... 36/114
5,826,351 A 10/1998 Tsuji
5,974,699 A * 11/1999 Park ..... 36/103
6,065,230 A * 5/2000 James ..... 36/25 R
6,260,289 B1 7/2001 Tsuji
6,523,281 B1 2/2003 Lennihan, Jr.
7,150,114 B2 * 12/2006 Park ..... 36/103
2005/0000115 A1 * 1/2005 Kimura et al. ..... 36/25 R
2005/0022425 A1 * 2/2005 Brown ..... 36/30 R
2007/0180732 A1 * 8/2007 Oh ..... 36/25 R

FOREIGN PATENT DOCUMENTS

WO WO 2006068392 A1 * 6/2006

OTHER PUBLICATIONS

I-ROC; http://www.i-roc.com/live; Jan. 4, 2007; 3 pages; US.
http://www.swissmasaius.com/product_detail; Masai Barefoot Technology; Mar. 16, 2006; 1 page.

* cited by examiner

*Primary Examiner*—Marie Patterson
(74) *Attorney, Agent, or Firm*—Patricia M. Mathers

(57) ABSTRACT

Shoe sole that promotes a natural walking gait by promoting the natural step motion of a barefoot person walking in sand. The shoe sole has is a single-shot injection molded sole that has a continuously, irregularly curved lower surface and a multi-contoured upper surface. The lower surface has a radius of curvature in the heel area that is smaller than the radius of curvature in the toe area. The upper surface has an arch support, a depression for cradling the ball of the foot, and flex zones that promote flexing of the shoe sole in the longitudinal and transverse direction.

13 Claims, 5 Drawing Sheets

SHOE SOLE

BACKGROUND INFORMATION

1. Field of the Invention

The invention relates to the field of shoes. More particularly, the invention relates to shoe soles.

2. Description of the Prior Art

The natural design of the foot enables a smooth rolling motion throughout a step when walking. Studies of people's footprints in sand show that the foot rolls from heel to toe and, at the same time, also from an outside slant (supination) to an inside slant (pronation), in a smooth rolling motion. The step begins with setting the heel down on the walking surface and ends with the large toe pushing the foot off the walking surface. The toe at the end of the step and the heel at the beginning of the step are on the same plane. The center of gravity of the person is applied forward of the ankle, so that, in a normal standing position, the greatest portion of body weight is borne by the front portion of the foot, i.e., the ball and toes, and not the heel.

Traditional shoe soles cancel much of this natural design. Most traditional shoe soles are constructed with a heel portion that raises the bottom horizontal plane of the heel above the bottom horizontal plane of the ball of the foot and toes. This orientation of the foot distorts the natural interaction of certain foot joints and ligaments and results in chronic tension that leads to inflammation of various foot joints. With these traditional shoe soles, when the step begins, the heel is set down at an elevated level above the walking surface. The ball of the foot and the toes are at an unnatural angle relative to the heel, and, as the foot moves through the step, the ball of the foot drops, rather than rolls, onto the walking surface. The joints and ligaments are not in their natural and intended orientations and, as a result, the toe cannot push the foot away from the walking surface naturally. The raised heel portion forces the center of gravity of the body off-center, back toward the ankle and heel. Too much weight is placed on the heel. This overloads certain joints in the foot and causes bone spurs and other problems in the heel. The shift in the center of gravity also typically causes misalignment of the knees and of the hips. Many of the muscles intended to be used in walking are not used properly and, as a result, atrophy from lack of use. This chronic misalignment of the foot during walking leads to foot fatigue and the development of chronic postural problems, with the result that many people complain of problems with their feet, ankles, knees, and even lower spine.

Traditional shoe soles also inhibit the natural rolling motion from the outside edge to the inside edge of the foot as it goes through the step motion. Traditional shoe soles flex only along lines that run transverse to the longitudinal direction of the shoe sole, and are typically constructed to prevent flexure in the longitudinal direction, that is, they do not flex along longitudinal lines, from the outer side to the inner side of the foot.

Many efforts have been made over the years to construct a shoe sole that promotes a healthy and natural walking gait, alleviates foot pain, and does not cause fatigue. Some shoe soles have a negative heel portion. This type of sole creates tension in other parts of the foot and lower spine and does not promote a natural gait. Some shoe soles are constructed with a tripartite sole. The middle portion of the tripartite sole presents a flat bottom surface. The front portion of the sole has a flat bottom surface that is angled upward relative to the middle portion. The rear portion of the sole also has a flat bottom surface that is also angled upward, relative to the middle portion, but at a lesser angle than that of the front portion. The upper surface of the sole is flat, from heel to toe. Thus, the sole does not support the arch or the toes. The tripartite lower surface causes an abrupt rocking motion through the step and also requires that the wearer have a good sense of balance.

Conventional shoe soles have a flat upper surface. A formed insole is the placed on top of the shoe sole. This insole is typically made of a soft, cushioning material, and does not provide the even, continuous support along the bottom of the foot that is needed when walking.

What is needed, therefore, is a shoe sole that allows the foot to roll naturally from heel to toe and side to side. What is further needed is such a shoe sole that supports the entire foot throughout the entire step.

BRIEF SUMMARY OF THE INVENTION

The invention is a shoe sole with a rocker or roller bottom that is a continuously curved bottom surface. The shoe sole has a bottom surface that contacts the walking surface and an upper surface that contacts the foot of the wearer. The continuous curve curves downward from the heel section through a mid-section that presents the lowest point of the continuous curve, and then upward to the toe section. The angle of curvature is not the same throughout the sole. Rather, the angle of curvature of the heel portion, relative to the curvature of the mid-section, is greater than the angle of curvature of the toe-section. Also formed in the lower surface is a longitudinal flex groove that allows the shoe sole to flex along lines that extend in the longitudinal direction of the shoe sole, thereby allowing the foot to roll naturally from side to side simultaneously as it rolls from the heel toward the first toe.

The upper surface of the shoe sole is a multi-planed formed surface that supports the entire bottom of the foot and maintains the foot in proper alignment, while allowing the foot to roll naturally from side to side and from heel to toe throughout the step motion. The upper surface has a heel section, an arch section, a ball section, and a toe section. The arch section rises above the level of other areas on the upper surface and supports the arch throughout the entire step. The ball section has a depression that cradles the ball of the foot. The toe area aligns the toes properly, particularly the first toe, so that it is in proper position to push the foot away from the walking surface.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiment of the invention is shown. This invention should not, however, be construed as limited to the embodiment set forth herein; rather, the drawings are provided so that this disclosure will be complete and will fully convey the scope of the invention to those skilled in the art.

Figure 1:
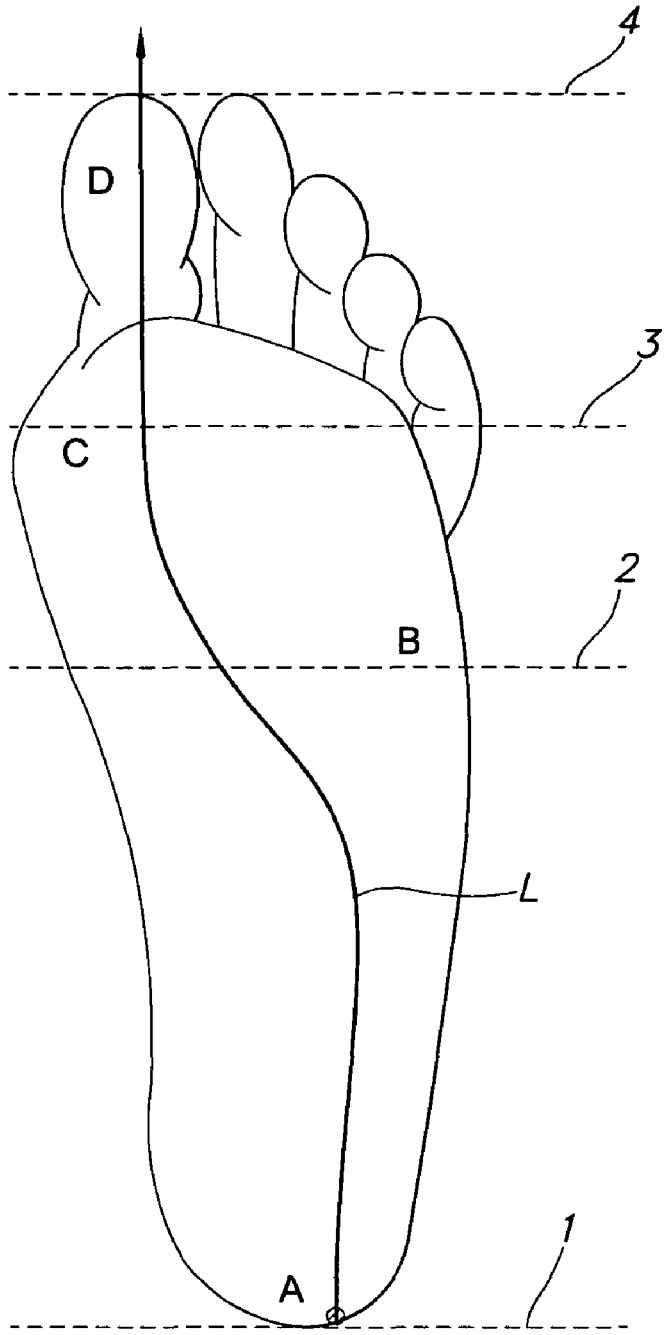
FIG. 1 illustrates the shifting of the center of gravity along the foot when walking barefoot on sand.
Figure 11:
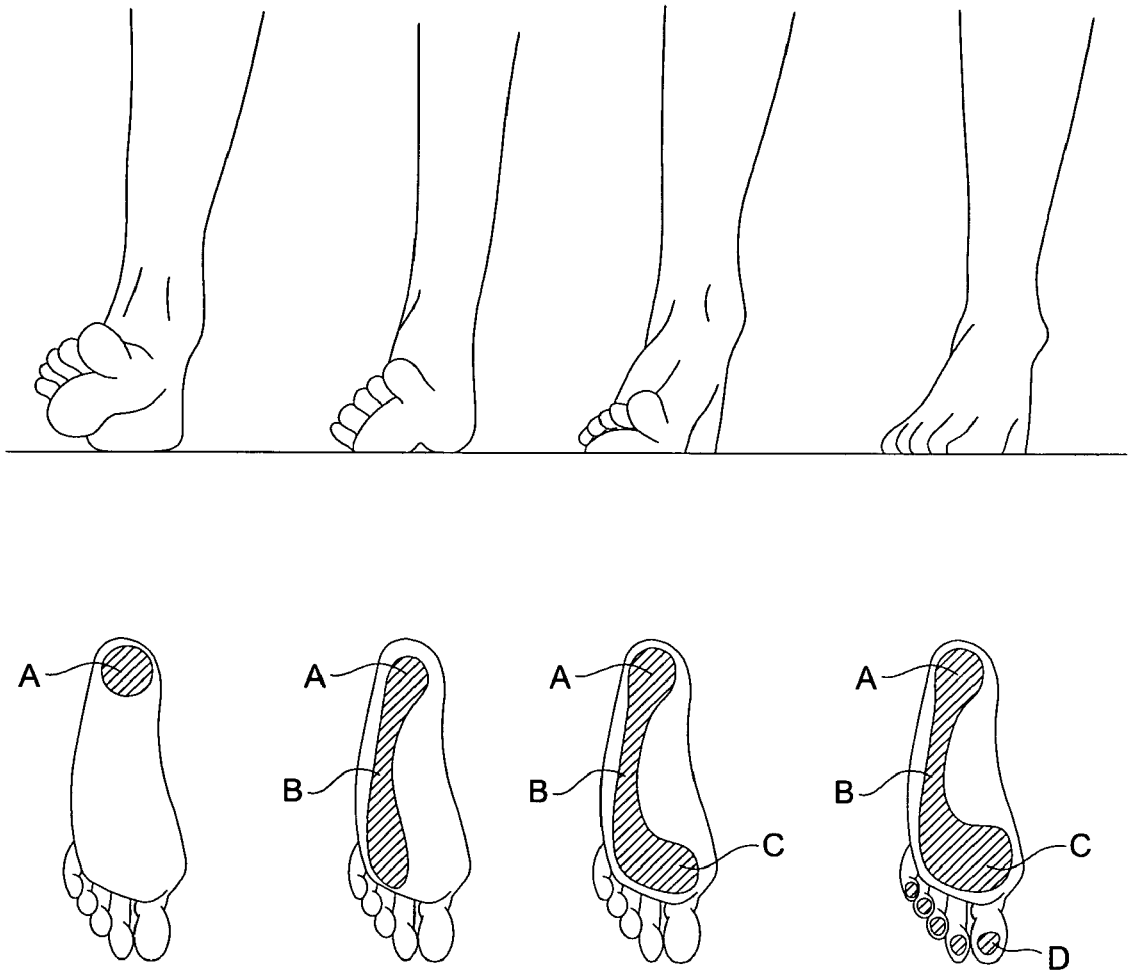
FIG. 11 illustrates the how the body weight is applied to the bottom surface of the foot, when walking barefoot on sand.

FIGS. 11 and 1 illustrate the natural motion of the foot through a complete walking step, from 11A through 11D. The upper portion of FIG. 11 shows a foot going through the walking step; the lower portion shows how the body weight is shifted along the sole of the foot. The areas A through D in FIG. 11 correspond to the similarly marked areas in FIG. 1. The shift in center of gravity is illustrated generally by line L in FIG. 1. The foot first comes into contact with a walking surface at 1 and rolls in a forward direction from heel A at 1 to toe D at 4, where the foot pushes away from the walking surface. The foot also rolls simultaneously from side to side. Initially, the foot rolls outward, shifting the weight from the heel A toward the outer lateral side B. Then, as the back of the foot lifts away from the walking surface, the toes D turn down and the foot rolls over to the inner side, shifting the weight onto the ball area C. In the final phase of the step, the kicking off phase, the foot bends at the toes and the weight is shifted primarily onto the first toe D at 4, at which point the toe pushes the foot away from the walking surface. This forward and side-rolling motion is the natural motion for a barefoot person walking on a surface such as sand. The shoe sole 100 of the present invention emulates and promotes this same natural forward and side-rolling motion.

Figure 2:
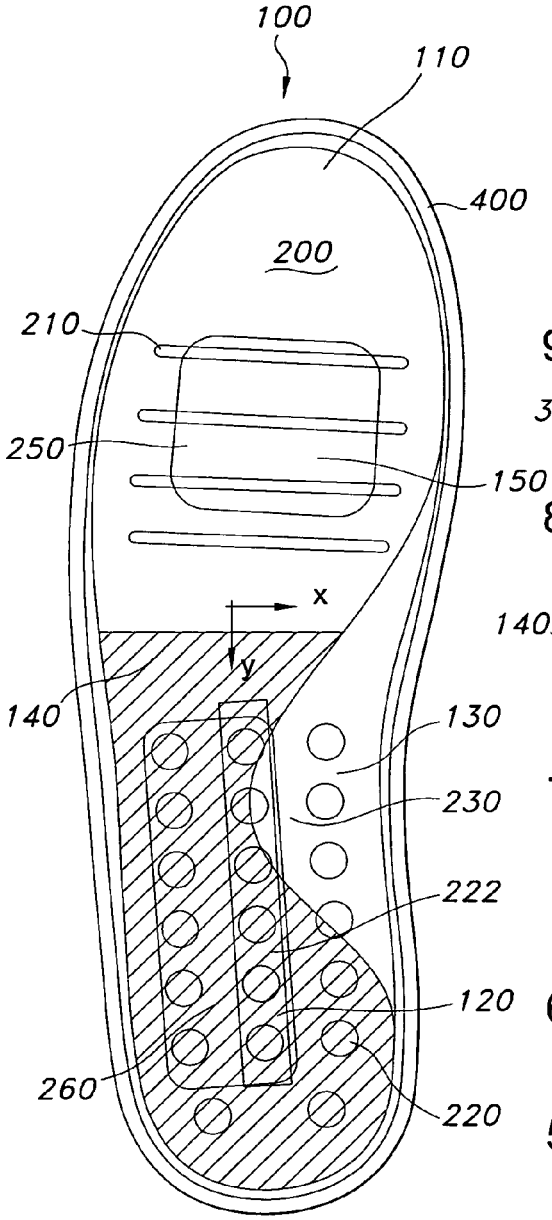
FIG. 2 is a plane view of the upper surface of the shoe sole.
Figure 3:
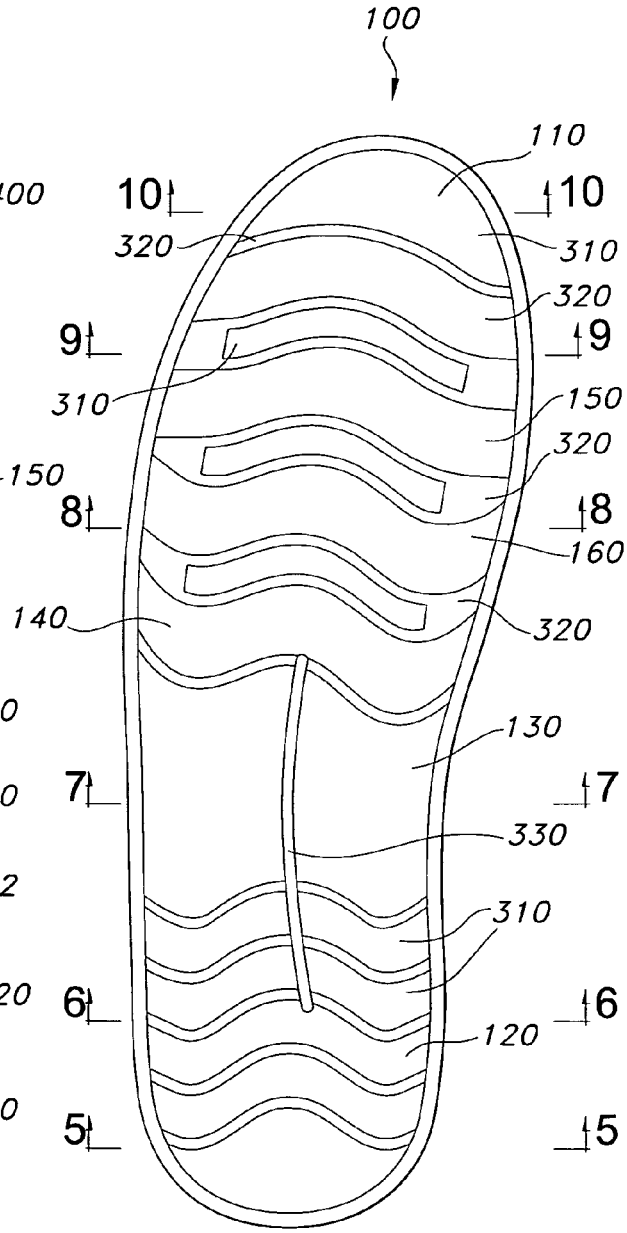
FIG. 3 is a plane view of the bottom surface of the shoe sole.
Figure 4:
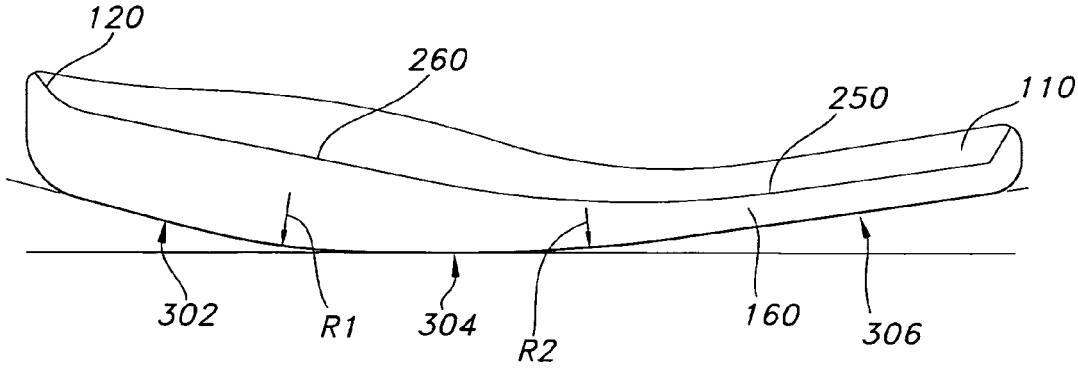
FIG. 4 is a side plane view of the shoe sole, from the inner side, showing two different curvatures on the front and rear portions of the shoe sole, and the ball depression in the front portion.

FIGS. 2-10 illustrate a shoe sole 100 according to the invention. In the preferred embodiment, the shoe sole 100 is a single-shot injection molded sole, although it is understood that it may also be made as a double-shot injection molded sole. FIG. 2 shows an upper surface 200, FIG. 3 a lower surface 300, and FIG. 4 shows a side view of the shoe sole 100. FIGS. 5-10 show transverse slices of the shoe sole 100, which illustrate the various features and contours at different locations on the sole. The shoe sole 100 has a toe area 110, a heel area 120, an arch area 130, a outer side 140, an inner side 150, and a ball area 160. Directional arrows X and Y indicate a transverse direction or orientation and a longitudinal direction or orientation, respectively.

Figure 6:
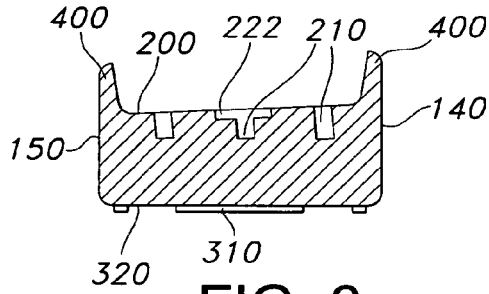
FIG. 6 is a transverse slice of the shoe sole across the mid-heel area.
Figure 7:
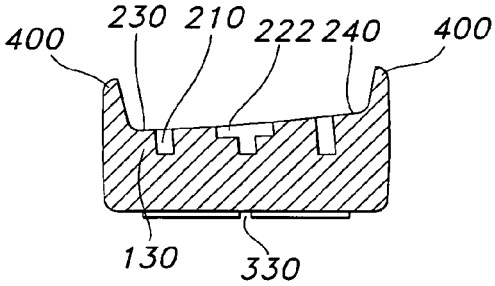
FIG. 7 is a transverse slice of the shoe sole across the arch area.

Referring now particularly to FIG. 2: The upper surface 200 has a first flex zone 210 in the ball area 150 for increasing the ability of the shoe sole 100 to flex in this area in the transverse direction. In the embodiment shown, the flex zone 210 is defined by a series of transverse grooves. A second flex zone 220 is formed in the heel area. This second flex zone 220 reduces the weight of the shoe sole 100, as well as increases the ability of the sole 100 to flex, both in the transverse direction X and in the longitudinal direction Y. Depending on the size of the particular shoe sole or the body weight of the intended wearer, it is understood that the flex zones 210 and 220 may be adapted to provide greater or lesser flex. A recess 222, best seen in FIGS. 6 and 7, is also formed centrally along the heel area 120 for receiving a reinforcing bar. An arch support 230 is formed on the inner side 130, which supports the arch throughout the walking step and holds the foot in a slightly supinated position, that is, oriented toward the outer side 140, for the first half of the step. A side wall 400 that is adapted to attach to an upper shoe rises from and encircles the upper surface 200.

FIG. 2 further illustrates a flat area 260 delineated with hatch lines and a ball depression 250 formed in the ball area 150. The flat area 260 is a plane surface and the ball depression 250 cradles the ball of the foot. The flat area 260 includes the heel area 120 and the outer side 140. The arch area 130 is raised relative to the flat area 260. The lower plane of the ball depression 250 is lower than the plane of the flat area 260. The plane of the toe area 110 is raised, relative to the lower plane of the ball depression 250. Together, the ball depression 250 and the flat area 260 bed the foot in a way that accommodates the natural curve of the foot of a barefoot person standing on sand, and also stabilize the balance of the person while standing still. Thus, although the lower surface 300 is continuously curved, the upper surface 200 provides a stable bed for the foot, so that the wearer does not have to continually seek a balance point or balance on the toes, when standing still.

Referring now particularly to FIG. 3: Traction pads 310 are formed along the lower surface 300, separated by transverse flex grooves 320. The transverse flex grooves 320 vary in size and shape and are constructed to control the amount of flex in the heel, ball, and toe areas 120, 150, and 110. A longitudinal flex groove 330 extends through the arch section 130 into the heel section 120 and controls the amount of side-to-side flex in the arch area 130. The longitudinal flex groove 330 extends from the arch section 130 to an inside area of the heel section 120. This longitudinal flex groove 330 promotes flexing of the shoe sole 100 in the longitudinal direction Y, to accommodate a shift in body weight from the outer lateral side B of the foot to the first toe D. See also FIGS. 12 and 13, which illustrate the flexing of the shoe sole 100 as the foot rolls from the outer side 140 to the inner side 150. This shift in body weight occurs in a natural walking gait of a barefoot person walking on a sand, for example, and is prevented by conventional shoes, which allow the sole to flex in the transverse direction only.

FIG. 4 is a side view of the inner side 150 and outer side 140 of the shoe sole 100 and particularly illustrate that the lower surface 300 is an irregularly, yet continuously curved surface. A first curve 302 in the heel area 120 has a radius of curvature greater than that of a second curve 306 in the ball and toe areas 160 and 110. A transition curve 304 in the arch area 130 is a continuous curve that transitions from the first curve 302 to the second curve 302. In the embodiment shown, the first curve 302 has a radius R1 of 291.22 mm and the second curve 306 a radius R2 of 710.51 mm, whereby the radius R1 is preferably a minimum of 272.0 mm. These radii were selected, because they provide a stable comfortable walking posture for the average person. Other suitable radii of curvature may be selected, as long as they provide a stable and comfortable walking posture.

Figure 5:
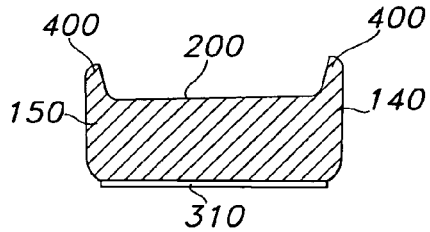
FIG. 5 is a transverse slice of the shoe sole across the rear heel area.

FIG. 5 shows a transverse slice across the very rear section of the shoe sole; FIG. 6 shows a transverse slice across the middle section of the heel area 120. The outer side 140 of the upper surface 200 is slightly lower than the inner side 150, to promote a roll of the foot to the outer side during the first half of the step motion, that is, when the heel is placed on the walking surface. A recess 222 is provided for a reinforcing bar 222A. The arch area 130 compresses somewhat, depending on the weight of the person. The reinforcing bar 222A prevents this compression from deforming the flat area 260 that runs parallel to both sides of the reinforcing bar 222A and ensures that the shoe sole 100 applies even pressure to the bottom of the foot.

FIG. 7 shows a transverse slice across the arch area 130, illustrating an arch support 230 that is noticeably raised above the level of the outer side 140.

Figure 8:
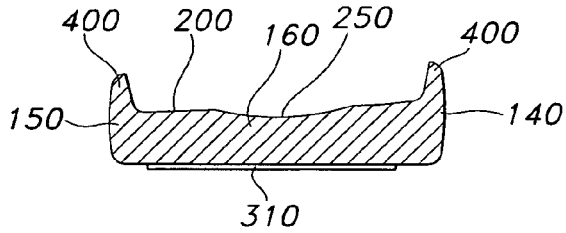
FIG. 8 is a transverse slice of the shoe sole across the front of the sole, just behind the ball area.

FIG. 8 shows a transverse slice across of the ball area 160, illustrating the ball depression 250. The inner side 140 is now very close to the same level of the outer side 140. When the foot rolls naturally from the heel onto the ball, it also rolls sideways into pronation, placing more of the body weight on the ball of the foot just behind the first toe. The ball depression 250 promotes this side-to-side roll and also keeps the ball of the foot and the toes from slipping in the transverse or longitudinal direction.

Figure 9:
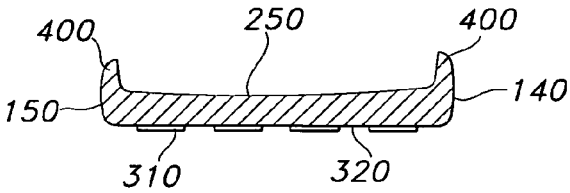
FIG. 9 is a transverse slice of the shoe sole across the ball area
Figure 10:
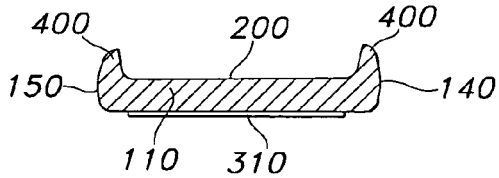
FIG. 10 is a transverse slice of the shoe sole across the toe area.

FIGS. 9 and 10 show transverse slices of the shoe sole across the front portion of the ball area 150 and the toe area 110, respectively. The ball depression 250 serves to hold the foot in a naturally curved orientation, with the ball of the foot in a lower plane than the toes and the arch. This ensures proper weight distribution in several ways. First, the arch of the foot remains in contact with the shoe sole over a greater area, effectively distributing the body weight evenly over the ball and arch areas. At the same time, the ball depression 250 increases the stability of the foot by bedding the ball area on a slightly lower plane, relative to the rest of the foot. Finally, the higher plane of the toe area 110, relative to the plane of the ball depression 250, raises the toes slightly, positioning them in a natural position to better to push the foot off against the walking surface.

Figure 12:
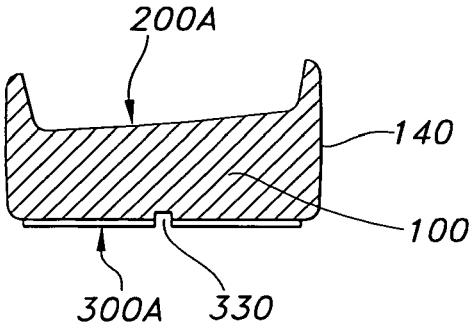
FIG. 12 shows the longitudinal flex groove under no-load condition.
Figure 13:
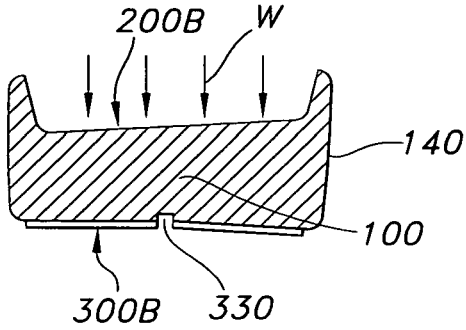
FIG. 13 shows the longitudinal flex groove flexing under load condition.

FIGS. 12 and 13 illustrate how the shoe sole 100 flexes in the longitudinal direction to allow the fool to roll from the outer side 140 to the inner side 150. FIG. 12 shows the upper surface 200, which is designated as 200A in this figure, in the area above the longitudinal flex groove 330. The upper surface 200A is flat, reflecting the condition of the shoe sole 100 when no weight is applied to the upper surface 200 of the shoe sole. FIG. 13 shows the shoe sole 100 with weight applied to the upper surface, also in the area above the longitudinal flex groove 330, which is designated in this figure as 200B. The upper surface 200B is tilted downward slightly, because the longitudinal flex groove 330 has allowed the shoe sole 100 to flex as the center of gravity of body weight shifts from the outer side 140 to the inner side 150. The upper surface 200A/200B coincides in part with the flat area 260 with the reinforcing bar 222A shown in FIGS. 6 and 7. The reinforcing bar 222A prevents the flat area 260 from buckling in a transverse direction X or overflexing, yet allows the area that runs parallel to the reinforcing bar 222A to drop off slightly in the longitudinal direction Y, to accommodate the roll of the foot from side to side. This interaction between the reinforcing bar 222A and the longitudinal flex groove 330 provides a continuous support on the foot and promotes good balance. The reinforcing bar 222A is constructed to allow this slight longitudinal flexing on the upper surface 200 and is adapted to the approximate weight of the intended wearer of the shoe. Shoes intended to be worn by persons weighing 120 or more, for example, may be made of metal, whereas shoes intended to be worn by children or other persons weighing less than 120 may be made of fiberglass. It is envisioned that a person acquiring a pair of shoes having the shoe sole 100 according to the invention will specify which type of reinforcing bar is desired.

Figure 14:
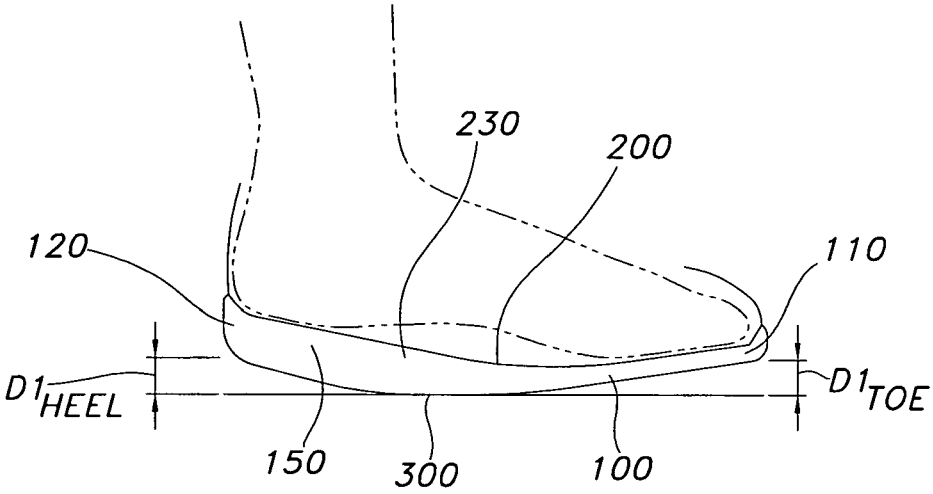
FIG. 14 shows the curvature of the sole, without the weight of the body applied to the foot.
Figure 15:
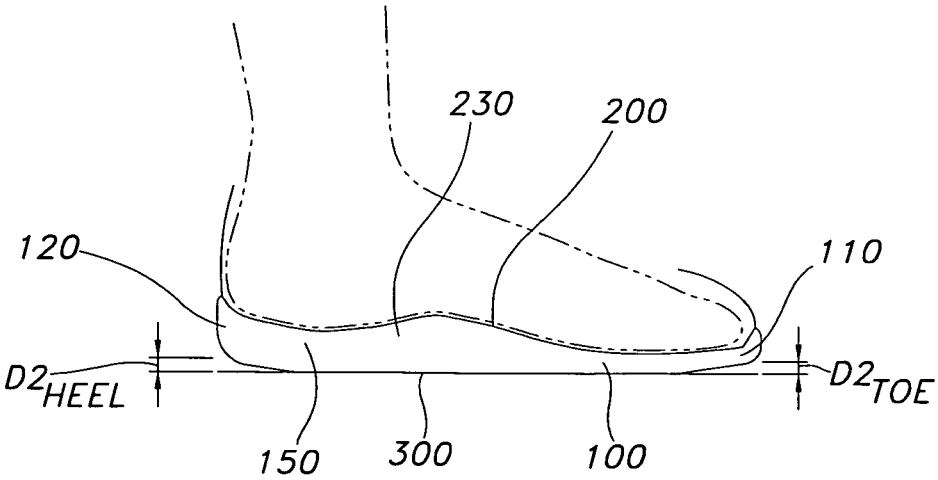
FIG. 15 shows the flattening of the sole and the increased support for the arch when body weight is applied to the foot.

FIGS. 14 and 15 are side cut-away views of the shoe sole 100, showing the upper surface 200 and the lower surface 300 in profile from the inner side 150. In FIG. 14 illustrates the curvature of the shoe sole 100 under no-load condition. As shown, the foot is resting in the shoe, with the arch of the foot naturally curved. No weight is applied to the arch of the foot at this time, that is, the foot is not bearing down on the upper surface 200. The lower surface 200 of the sole 100 is curved to its fullest extent, as shown by distances $D1_{HEEL}$ and $D1_{TOE}$. In FIG. 15, the weight of the body is applied to the shoe sole 100. The sole 100 flexes in the transverse direction in the area about the arch support 230, with the result that the lower surface 300 flattens out, as shown by distances $D2_{HEEL}$ and $D2_{TOE}$ and the upper surface 200 flexes upward into the foot, applying pressure evenly, thereby balancing the weight along the large bones in the foot, which are designed to carry the weight. The shoe sole 100 is now providing positive support for the entire surface of the foot: the heel, the arch, the ball and the toe areas.

It is understood that the embodiments described herein are merely illustrative of the present invention. Variations in the construction of the shoe sole may be contemplated by one skilled in the art without limiting the intended scope of the invention herein disclosed and as defined by the following claims.

What is claimed is:

1. A shoe sole for a shoe for a foot, the shoe sole having a longitudinal direction that extends between a toe end and the heel end and a transverse direction that extends between an outer side and an inner side of the of the shoe sole, said shoe sole comprising:

a molded shoe sole having an upper surface and a lower surface;

wherein said lower surface that is continuously curved, from a heel portion forward toward a toe portion with a ground surface;

wherein said lower surface includes a first portion having a first radius of curvature and a second portion having a second radius of curvature that is smaller than said first radius of curvature;

wherein said upper surface has a multi-planed contour that includes a heel section, an arch section, a ball section, and a toe section;

wherein said upper surface in said heel section and in said arch section has a plane that is higher along said outer side and lower along said inner side; and wherein, when a wearer wearing a shoe constructed with said molded shoe sole goes through a walking step, said continuously curved lower surface provides a continuous forward rolling contact of said lower surface with said ground surface in said longitudinal direction and said multi-planed upper surface facilitates a side rolling motion of said wearer's foot, initially toward said outer side and then toward said inner side and simultaneously a forward rolling motion of said foot in said longitudinal direction from said heel section through to said toe section, thereby promoting a natural forward-rolling and side-rolling motion that corresponds to a natural motion of a foot of a person walking barefoot on sand.

2. The shoe sole of claim 1, wherein said ball section has a depression for bedding a ball of a foot of a wearer, and a transverse flex-zone for providing transverse flexure in said ball area and thereby further promoting said forward rolling motion.

3. The shoe sole of claim 1, further comprising a longitudinal flex zone that extends from said heel section into said arch section, said longitudinal flex zone allowing flexure in said longitudinal direction, thereby promoting said side-rolling motion of said foot.

4. The shoe sole of claim 3, said longitudinal flex zone including a longitudinal flex groove on said lower surface extending in said longitudinal direction.

5. The shoe sole of claim 1, wherein said upper surface further includes a recess for receiving a reinforcing bar, said recess extending in said longitudinal direction from said heel end toward said arch section on said upper surface.

6. The shoe sole of claim 5 further comprising a longitudinal flex zone that allows said upper surface to flex in a longitudinal direction parallel to said reinforcing bar, so as to promote said side-rolling motion of said foot.

7. The shoe sole of claim 1, wherein said first radius of curvature is at least 272 mm.

8. The shoe sole of claim 1, wherein said first radius of curvature is in a range between 270 mm and 310 mm.

9. The shoe sole of claim 1, wherein said second radius of curvature is at least 690 mm.

10. The shoe sole of claim 1, wherein said second radius of curvature is in a range between 700 mm and 720 mm.

11. The shoe sole of claim 3, said longitudinal flex zone including a longitudinal flex zone on said upper surface for promoting said side-rolling motion of said foot.

12. The shoe sole of claim 11, wherein said longitudinal flex zone comprises a series of recesses formed in said upper surface.

13. The shoe sole of claim 5, wherein said reinforcing bar, when inserted into said recess, serves to ensure that an even pressure is applied to a sole of said foot, when said wearer goes through said walking step.

* * * * *